US006764562B1

(12) United States Patent
Persson et al.

(10) Patent No.: US 6,764,562 B1
(45) Date of Patent: Jul. 20, 2004

(54) COMPOSITE GAS-GENERATING MATERIAL FOR GAS-ACTUATED CAR SAFETY DEVICES

(75) Inventors: Svante Persson, Karlskoga (SE); Conny Sjöqvist, Karlskoga (SE)

(73) Assignee: Bofors Bepab AB, Karlskoga (SE)

( * ) Notice: Subject to any disclaimer, the term of this patent is extended or adjusted under 35 U.S.C. 154(b) by 0 days.

(21) Appl. No.: 09/959,945

(22) PCT Filed: May 4, 2000

(86) PCT No.: PCT/SE00/00864

§ 371 (c)(1),
(2), (4) Date: Nov. 13, 2001

(87) PCT Pub. No.: WO00/69792

PCT Pub. Date: Nov. 23, 2000

(30) Foreign Application Priority Data

May 12, 1999 (SE) ..... 9901726

(51) Int. Cl.[7] ..... C06B 47/10; C06B 31/00; C06B 25/34

(52) U.S. Cl. ..... 149/22; 149/45; 149/92

(58) Field of Search ..... 149/45, 88, 36, 149/19.1, 22, 92

(56) References Cited

U.S. PATENT DOCUMENTS

| | | | | |
|---|---|---|---|---|
| 3,468,730 A | | 9/1969 | Heinz et al. | |
| 3,719,604 A | | 3/1973 | Prior et al. | |
| 4,296,084 A | | 10/1981 | Adams et al. | |
| 5,695,216 A | | 12/1997 | Sandstrom et al. | |
| 6,077,372 A | * | 6/2000 | Mendenhall et al. | 149/109.6 |
| 6,214,138 B1 | * | 4/2001 | Canterberry et al. | 149/36 |

FOREIGN PATENT DOCUMENTS

| | | |
|---|---|---|
| GB | 943991 | 12/1963 |
| GB | 1126567 | 9/1968 |
| GB | 1210461 A | 10/1970 |
| SE | 514335 C2 | 2/2001 |
| SE | 9804610 A | 2/2001 |
| WO | WO 98/55428 | 12/1998 |
| WO | WO 00/40523 | 7/2000 |

OTHER PUBLICATIONS

Swedish Patent Office, International Search Report, Aug. 16, 2000, pp. 1–4.

* cited by examiner

*Primary Examiner*—Michael J. Carone
*Assistant Examiner*—Aileen B. Felton
(74) *Attorney, Agent, or Firm*—Connolly Bove Lodge & Hutz LLP

(57) ABSTRACT

The invention relates to a pyrotechnical composition which is intended both for a hybrid gas-generating material and for a purely pyrotechnical gas-generating material for use in gas-actuated car safety devices, and which comprises a first obligatory constituent in the form of 5–95 wt % of guanyl urea dinitramide and a second obligatory constituent in the form of 5–50 wt % of an oxidizing agent (calculated on the total amount of solids), together with—if it is necessary to increase the rate of burning—a combustion moderator in the form of 0–90 wt % of guanidine dinitramide or up to 10 wt % of finely divided metallic boron, as well as up to 10 wt % of a binder. The pyrotechnical composition according to the invention is characterized e.g. by a low pollutant emission, low smoke formation, and the fact that its rate of burning can be adjusted to suit any type of car safety device by varying the ratio between the constituents within the limits specified in the invention.

11 Claims, 5 Drawing Sheets

COMPOSITE GAS-GENERATING MATERIAL FOR GAS-ACTUATED CAR SAFETY DEVICES

Figure 1:
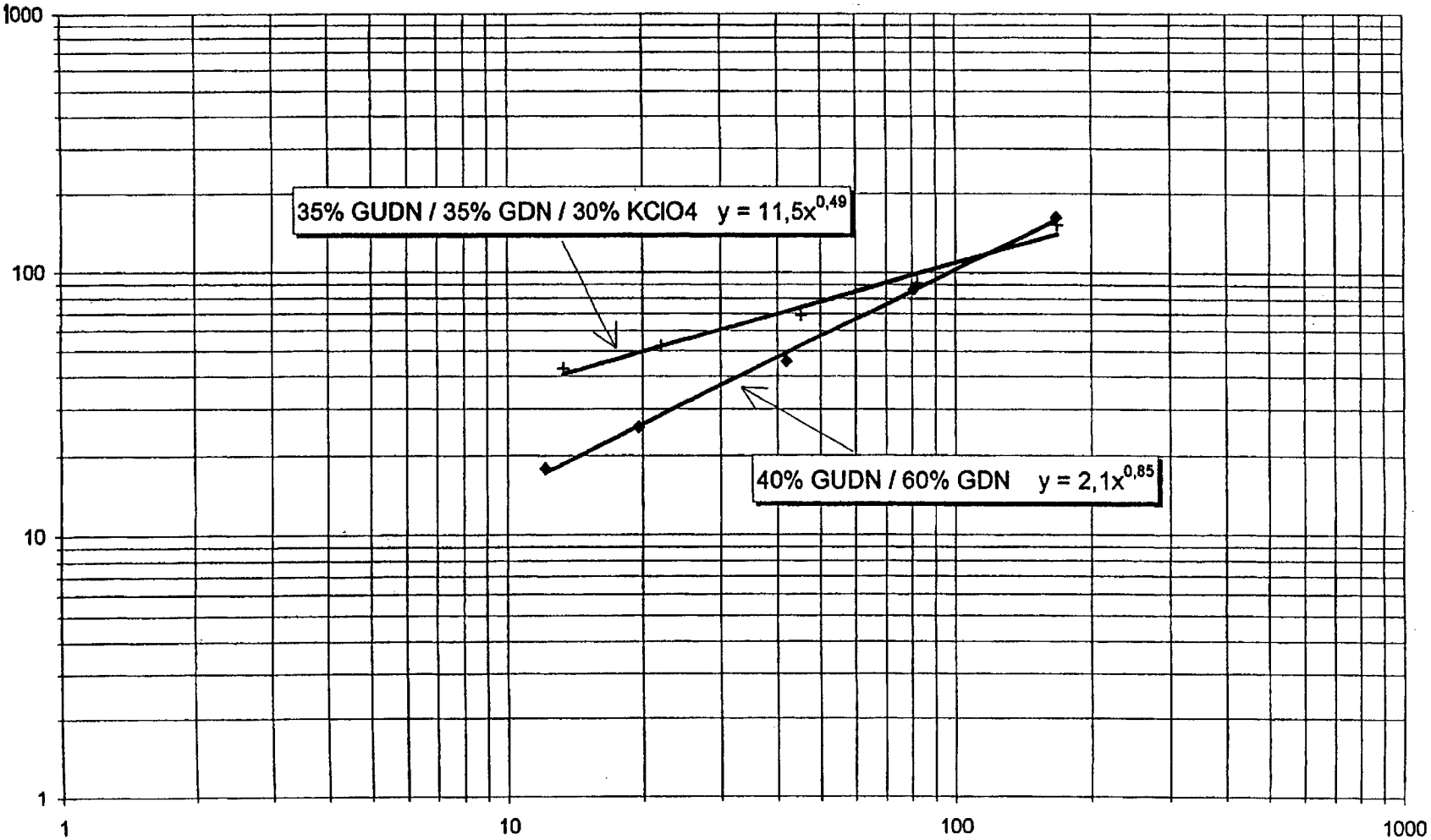

The function of pyrotechnical gas-generating substances used in air-bag assemblies is to fill the fabric pouch of the air bag with a gas quickly, in order to provide a flexible protecting medium between the passenger and the equipment in the car. Pyrotechnical gas-generating substances and the gas formed by them must meet a number of requirements in order to ensure that the air-bag assembly works properly and reliably, and that the environment is not harmed. The same requirements are also placed on the pyrotechnical gas-generating substances used in other gas-actuated safety devices fitted in cars, such as safety-belt tighteners, inflatable neck supports, etc.

Thus, the gas formed in all such car safety devices should not contain any hot solid particles that could burn through the main part of the system and set fire to the gas-filled fabric pouch and injure the passengers or jeopardize the entire operation of the safety device. Sodium azide, the most common pyrotechnical gas-generating substance used for this purpose nowadays, does not fully meet this requirement and must therefore be employed with specially reinforced fabric pouches to stop the penetration of the solid particles formed in the combustion of sodium azide. The need for this extra reinforcement means that such a safety device is larger and heavier than strictly necessary for its operation.

Furthermore, the environmental requirements placed on the pyrotechnical gas-generating substances used for the purpose in question stipulate that these substances must not form gaseous mixtures that contain poisonous gases in an amount that is harmful to health. The poisonous gases that are mainly relevant in this context because they are formed in the combustion of gas-generating substances are nitrogen oxides ($NO_x$) and carbon monoxide. If the gas-generating substance contains chlorine, then hydrochloric acid is also formed.

Furthermore, the pyrotechnical gas-generating substances used in a gas-actuated car safety device must have a high efficiency, i.e. they should form a large amount of gas per unit weight or volume of the gas-generating substance. However, the efficiency of sodium azide is not particularly high, since it only forms gas in an amount of about 40% of the solid substance. This low efficiency makes it difficult to meet the car manufacturers, requirement of car safety devices with a low weight and a small size when sodium azide is employed as a gas-generating substance. The main reason why sodium azide is still so widely used is that no better gas-generating substance has yet been found.

A further requirement placed on pyrotechnical gas-generating substances is that they should all be thermally stable in the sense that they should not be affected much by the high temperatures that can occur in the dashboard in countries with a warm climate. Nitrocellulose is an example of a substance that does not meet this requirement, but which might otherwise be suitable, and in fact it is used nowadays for this purpose, although it limits the service life of the car safety devices in question.

In addition to the above requirements, the product used in car safety devices as a pyrotechnical gas-generating substance must also meet several requirements concerning its combustion characteristics if a fully satisfactory operation is to be ensured. Thus, the ideal pyrotechnical gas-generating substance in this connection should have a high rate of burning and one that does not vary much with the pressure or the temperature. Sodium azide is an ideal substance from this point of view, but it has several disadvantages, as mentioned above.

There is another group of substances that generate gases when combusted and which have been tried as gas-generating materials for car safety devices. This group comprises nitramine-based gunpowder analogue compositions such as RDX, which are used e.g. in a mixture with cellulose acetyl butyrate. However, the disadvantage of nitramine-based gunpowder analogues is that their rate of burning depends on the pressure to a large extent. If the pressure is too low, the burning is completely extinguished, while if the pressure is too high, the combustion has an explosive course. According to U.S. Pat. No. 5,695,216, these disadvantages can be corrected by constructing a powerful container for the gas-generating substance and equipping the container with decompression means. However, even though this works (and works very well), the construction still requires extra parts and costs more.

The developments in the field of gas-actuated car safety devices therefore show that it is very difficult to find a completely ideal gas-releasing substance for this purpose.

The aim of the present invention is to solve this problem by using a substance that is completely new, at least in the context of gas-actuated safety devices and which—especially if combined with one or more other well-defined substances in accordance with the specific rules given below—provides a gas-generating composition (material) for the present purpose, that has almost optimum combustion characteristics and exhibits several other useful properties, described below, irrespective of whether the gas generators used with it are of the hybrid type or not. However, the mixing ratio of the substances according to the invention does depend to some extent on the type of safety device in question and on the protective function envisaged for it.

The first of the pyrotechnical gas-generating substances according to the invention, which is also the main component of the material according to the invention, is guanyl urea dinitramide (GUDN), which has the following chemical formula.

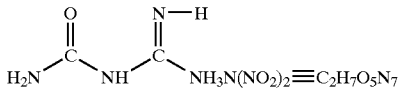

Guanyl urea dinitramide is relatively easily prepared by reacting guanyl urea with ammonium dinitramide. Pure guanyl urea dinitramide burns much less fast than sodium azide. In the pure form, its combustion is fairly independent of the pressure and temperature, and it stable even at a low pressure. Furthermore, guanyl urea dinitramide scores over sodium azide by burning entirely without forming any solid particles, due to its good intrinsic oxygen balance. In addition, it is thermally stable, with a melting point of over 160° C., and a decomposition temperature of 180° C.

As its structural formula shows, guanyl urea dinitramide has an extra carbon atom, which means that it must be burned with an oxygen excess to ensure that no carbon monoxide persists as a residual product. The necessary oxygen excess can come from a solid substance that forms part of the pyrotechnical gas-generating material releasing a gas on its combustion, or else it can come to various extents from a substance supplied in the gaseous phase. This latter is the case with a "hybrid" gas-generating material, which comprises both a pyrotechnical gas-generating part (releasing a gas during its combustion) and a gaseous component that is supplied in the form of a compressed gas from the beginning. The oxygen excess can then be partly provided by this gaseous component, which can be e.g. pure oxygen or nitrous oxide ($N_2O$), also called "laughing gas". The oxygen-rich component is thus the second constituent according to the present invention. When this second component is a solid substance, it can be chosen from one or more of the following three groups of substances:

Group 1: nitrates, perchlorates and permanganates of alkali metals

Group 2: oxides of iron, nickel, cobalt and metals in the manganese group

Group 3: oxides of the transition metals in Groups 7–12 of the Periodic Table.

However, the rate of burning of pure guanyl urea dinitramide is so much lower than that of sodium azide even in the presence of an oxygen excess that in certain cases it can be too low for some of the applications in question. However, it closely resembles chemically another substance—guanidine dinitramide (GDN)—which has been proposed for a similar purpose before and which has a considerably higher rate of burning. This makes both these substances particularly suitable for use as each other's combustion moderators for regulating the rate of burning of their mixtures with each other. By mixing these two substances it has therefore been possible to prepare gas-generating materials with a rate of burning suitable for each particular purpose. Guanidine dinitramide is thus the third component according to the present invention, even if it is an optional component, which can be omitted when there is no need for a particularly high rate of burning.

Guanidine dinitramide, which has the following chemical formula, can be relatively easily prepared from guanidine and ammonium dinitramide.

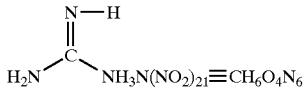

Pure guanidine dinitramide burns very fast even at a low pressure, and its combustion is not very pressure-dependent, having a pressure exponent of about 0.8. At atmospheric pressure, guanidine dinitramide burns faster than nitrocellulose and almost as fast as sodium azide. A significant advantage over sodium azide is, furthermore, that guanidine dinitramide does not form any solid combustion products but is instead fully converted into gases on combustion. This means in turn that, when guanidine dinitramide is used as a gas-generating substance in air-bag assemblies, no extra reinforcement is needed for the gas pouches in order to prevent the substance from burning through them. This fact enables the designers of such car safety devices to reduce the weight and size of the latter without jeopardizing their operation. Moreover, guanidine dinitramide only contains one carbon atom, so that advantageously little carbon monoxide is formed in its combustion. In addition, guanidine dinitramide has an ideal thermal stability, with a melting point in excess of 130° C. and a decomposition temperature of over 160° C.

A way of increasing the rate of burning of guanyl urea dinitramide, if necessary, is therefore to admix guanidine dinitramide to it in amounts of—if necessary—up to 90 wt %, calculated on the total composition.

Another—previously unknown—way of increasing the rate of burning of guanyl urea dinitramide in an oxygen excess is to add small amounts of finely divided metallic boron, which then replaces guanidine dinitramide and is needed in considerably smaller amounts. Suitable amounts of boron acting as a combustion moderator are up to 10 wt % and preferably in the range 0.5–3 wt %. The addition of boron in this range makes it possible to fully replace guanidine dinitramide, while guanyl urea dinitramide remains the main gas-generating substance. Apart from the advantage of being able to use a relatively small amount of boron, the combustion curve for the mixture becomes even less pressure-dependent, and its temperature dependence is very low.

Both guanyl urea dinitramide (GUDN) and guanidine dinitramide (GDN) are finely crystalline substances with a normal particle size of under 100 mesh. With their normal crystallite size they can be pressed into shapes and have a good mechanical strength in the pressed form. This also applies in general when these compounds are used in mixtures with other finely divided substances. In most cases, it should therefore be appropriate to use either the pure substances or their mixtures with each other, in the form of pressed tablets. If required, a binder used in a small amount—preferably not more than 10 wt %, calculated on the total amount of solids—may be added to confer an even better mechanical strength on the pressed tablets. Especially certain solid oxidizing agents may call for the addition of a binder.

The main component (guanyl urea dinitramide) and the optionally added substance (guanidine dinitramide) according to the invention have the further advantage that, when they finish their service life as potential gas-generating substances in a car safety device, which hopefully has not seen active use, they can be easily recovered for re-use as gas-generating substances in a similar or a different product.

When preparing new chemicals nowadays, it is essential to bear in mind, for environmental reasons, how they can be recovered and re-used. Yet none of the materials employed nowadays as gas-generating substances in car safety devices can be recovered in a simple manner when they have come to the end of their service life without active use. Besides, as these car safety devices are products that preferably should not see active service, it can be expected that the number of unused units of such gas-generators that have to be collected after the vehicles equipped with them are scrapped will increase at the rate at which these safety devices are installed in new cars.

Sodium azide, which is nowadays used in car safety devices on a large scale, is in fact always employed in a mixture also comprising $Fe_2O_3$ and silicates, and no effective way of re-using these substances is known today. Furthermore, sodium azide is very toxic, which is another reason why it must be destroyed as soon as possible when the car safety device incorporating it has reached the end of its service life. Similarly, nitrocellulose cannot be re-used either, because it is unstable and decomposes in the course of time. The only practical method of destroying nitrocellulose collected from scrapped products is therefore exactly the same as in the case of sodium azide, i.e. incineration.

By contrast, guanyl urea dinitramide and guanidine dinitramide are uniform and stable crystalline products that can furthermore be easily recrystallized. If despite everything they undergo decomposition to some extent, they can still be re-used after recrystallization. The fact is that this process removes any decomposition products, and so the recrystallized compound is entirely comparable with the newly produced one. A further advantage is that these two compounds can be recrystallized from water without the use of solvents. This possibility of recovering and recycling the gas-generating substances from scrapped car safety devices of the kind considered here has of course significant environmental benefits in comparison with the currently customary azides and nitrocellulose-based gunpowder analogues, which must always be destroyed by incineration.

Guanyl urea dinitramide is fairly insoluble in cold water, is not hygroscopic but moderately soluble in warm water, whereas guanidine dinitramide is moderately soluble in water at room temperature. Both compounds can therefore be recrystallized from water at a low temperature. This is a particularly simple and cheap process, which should make it possible to recover and re-use the gas-generating substances from non-deployed scrapped air-bag assemblies and other similar pyrotechnically actuated car safety devices.

As mentioned before, the present invention relates to a composite gas-generating material for car safety devices, as mentioned before. According to the invention, this gas-generating material comprises a first obligatory component in the form of guanyl urea dinitramide (GUDN), which can be complemented by the optional gas-generating substance, guanidine dinitramide (GDN), if a higher rate of burning is required. Guanidine dinitramide is used in a relatively large amount (see later), but it can be advantageously replaced according to the present invention by a considerably smaller amount of finely divided boron. In addition, an oxygen source (Component C), chosen from one or more of the above groups 1–3, is incorporated as an obligatory component. However, in the case of hybrid gas-generating materials, part of this oxygen source can be replaced by gaseous oxygen, as mentioned before.

The invention therefore consists of a gas-releasing pyrotechnical substance with the following composition, formulated for use in car safety devices:

5–95 wt % of guanyl urea dinitramide (GUDN)

5–50 wt % of a solid oxygen source (Component C) if a higher rate of combustion is required 0–90 wt % of guanidine dinitramide (GDN)

or 0.5–10 wt % of finely divided metallic boron, together with not more than 10 wt % of a possibly combustible binder, calculated on the total solid composition.

Furthermore, the oxygen source (Component C) can be replaced by an oxygen-rich gaseous substance to various extents, as described below.

The invention therefore also stipulates that the amount of the solid oxygen-rich substance (Component C) should be 5–15 wt % and preferably of t he order of magnitude of 10 wt %, calculated on the total amount of solid substances when mixtures of guanyl urea dinitramide (GUDN) and guanidine dinitramide (GDN) are used as gas-generating substances in a hybrid gas-generating composition. The remaining oxygen requirement is then provided by the compressed gas component of the hybrid gas-generating composition.

However, the situation is somewhat different when mixtures of guanyl urea dinitramide and boron are used as the main gas-generating substances in hybrid gas-generating compositions. The fact is that it has been found that in such a case an amount of up to 50 wt % and preferably 30–40 wt % of an oxygen-rich so lid component is needed (calculated on the total solids) in order to ensure the maxi mum combustion of the resulting carbon monoxide into carbondioxide, and the remaining oxygen requirement is then again supplied by the compressed gas component of the hybrid gas-generating composition. The reason for this difference between the various mixtures is that guanidine dinitramide has a better oxygen balance than guanyl urea dinitramide.

The present invention also stipulates that the combustion of the gas-generating material always takes place in an oxygen excess, and it has been found that this has a favourable effect on the pressure exponent during the combustion.

The pyrotechnical gas-generating material according to the invention produces very little smoke when combusted, so that when it burns and the air bag assembly is released, one never gets the impression that a fire has started in the car, as happened before with air bag assemblies operating e.g. with sodium azide.

Another advantage of the pyrotechnical composition according to the present invention is that harmful residual products like $NO_x$ and CO are formed in small amounts during the combustion. The usual requirement in the automobile sector is that the amount of carbon monoxide should not exceed 400–600 ppm and the amount of nitrogen oxides should not exceed 50–70 ppm in a car interior of 2.5 m3. This can be achieved without difficulty when the pyrotechnical substances according to the present invention are used.

The invention is specified in the Claims and explained in more detail in the following Examples, where:

| | |
|---|---|
| GUDN = | guanyl urea dinitramide |
| GDN = | guanidine dinitramide |
| C = | oxygen source, irrespective of whether it is solid and/or gaseous. |

EXAMPLE 1

Illustrates the Rate of Burning of the Pyrotechnical Composition as a Function of the Combustion Pressure A fixed amount of the components in the form of pressed tablets was burned with an auxiliary pressure-raising material in the form of a standard amount of gunpowder analogue in a pressure-resistant bomb. The pressure in the bomb was measured with a manometer, and the rate of burning was determined from the curves for the change in pressure. The values of the measurement can be seen in FIG. 1.

EXAMPLE 2

Shows the Temperature-dependence of Mixtures of Guanyl Urea Dinitramide, Guanidine Dinitramide and an Oxygen Source (C)

Figure 2:
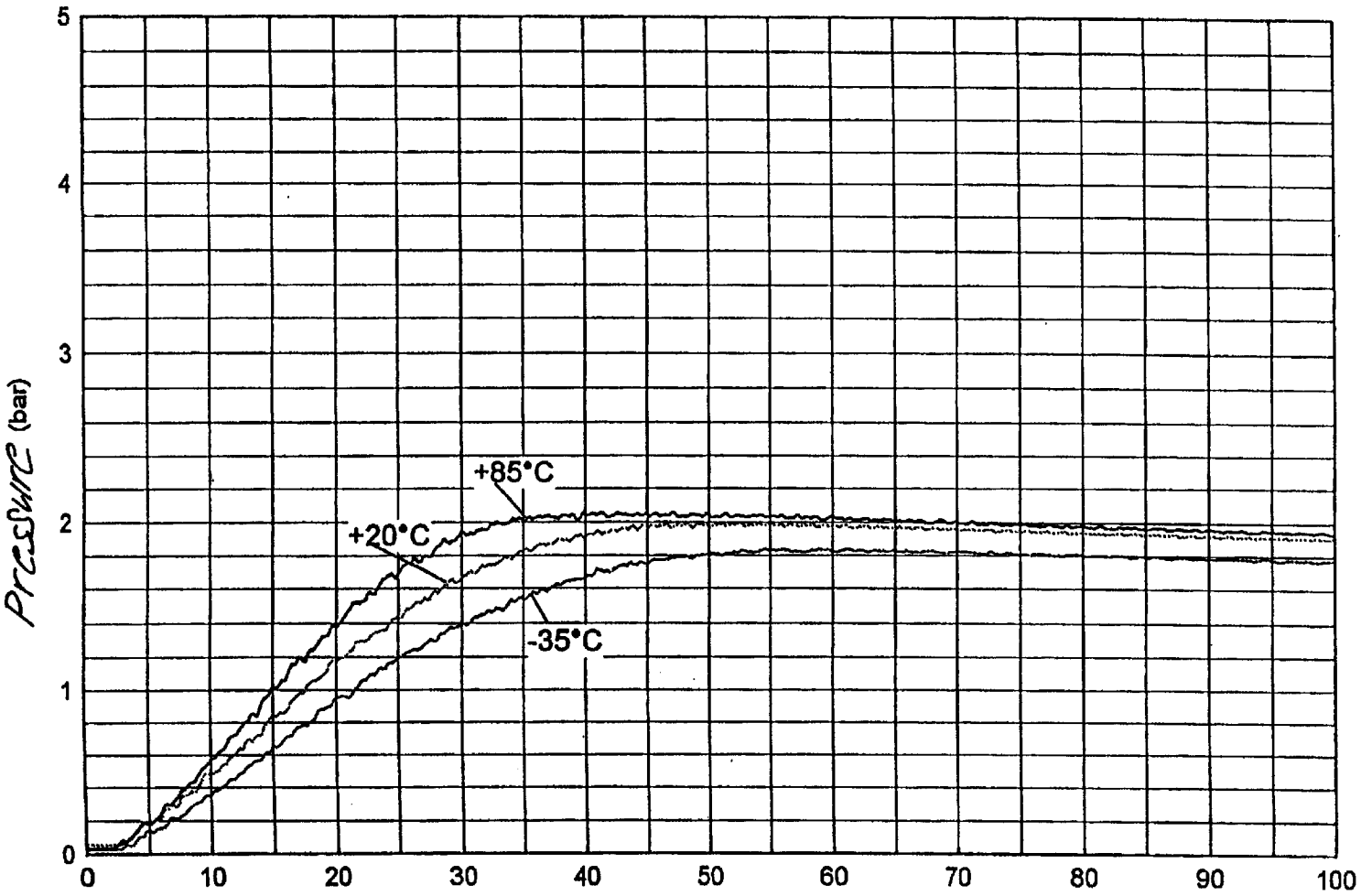

A low temperature-dependence is an essential requirement in the present context. The composition comprised 41 wt % of guanyl urea dinitramide, 41 wt % of guanidine dinitramide and 18 wt % of $KNO_3$, acting as an oxygen source. This mixture was burned in a hybrid gas generator, in which the gas in the bottle contained 19% of oxygen. The composition was burned at three different temperatures, namely at −35, +20 and +85° C. The hybrid gas generator was placed in a tank with a capacity of 146 liters, in which the pressure was measured. The results of the measurement are listed below and shown in FIG. 2.

| Temperature, ° C. | Maximum pressure, bar | Time to 90%, of max. pressure, msec |
|---|---|---|
| −35 | 1.83 | 39 |
| +20 | 1.99 | 34 |
| +85 | 2.05 | 28 |

EXAMPLE 3

Illustrates the Temperature-dependence of the Pressure/time Curve for Mixtures of Guanyl Urea Dinitramide and an Oxygen Source (Component C)

Figure 3:
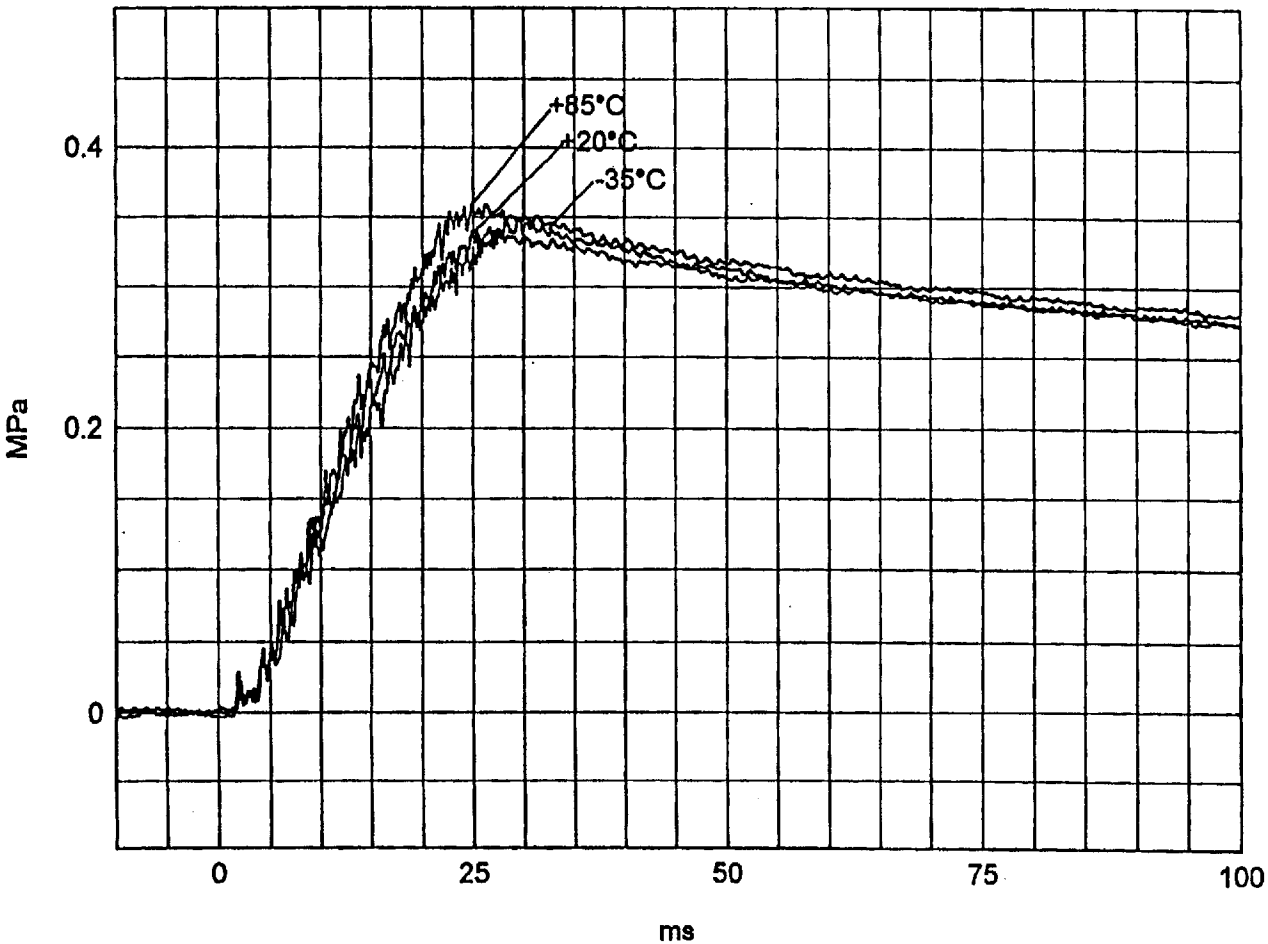

The charge consisted of 70 wt % of guanyl urea dinitramide and 30 wt % of $KNO_3$, acting as the oxygen source. The experiment was carried out as in Example 2, and the measurements were performed in a "secondary volume" outside the gas generator. The experimental values obtained are shown in FIG. 3.

EXAMPLE 4

Shows the Pollutant Emission from Mixtures of Guanyl Urea Dinitramide, an Oxygen Source (Component C) and Boron The composition consisted of 66 wt % of guanyl urea dinitramide, 32 wt % of $KNO_3$ and 2 wt % of boron. It was burned in a hybrid gas generator, in which the gas in the bottle contained 19% of oxygen. The hybrid gas generator was placed in a tank with a capacity of 100 cubic feet, corresponding to the interior of a car. The gas sampled after the combustion contained 50 ppm of CO and 6 ppm of $NO_x$ as pollutants. These values are well below the limits generally stipulated for these compounds in the automobile sector.

EXAMPLE 5

Figure 4:
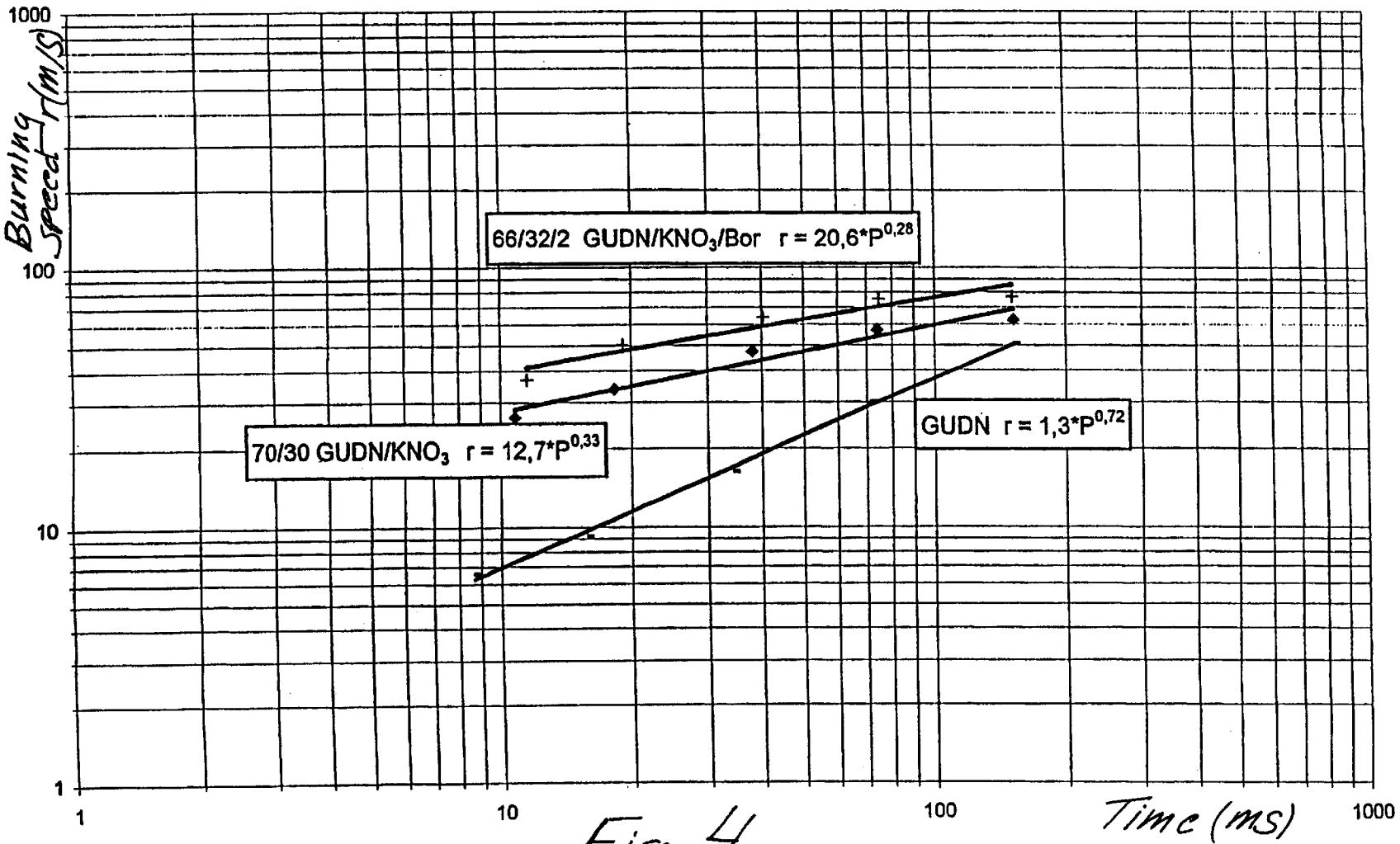

Relates to FIG. 4 and shows the rate of burning measured here as a function of the combustion pressure in the case of guanyl urea dinitramide with or without $KNO_3$ in one case, and with or without a mixture of $KNO_3$ and boron in the other. The results shown in FIG. 4 indicate that the rate of burning does not depend much on the combustion pressure, and the addition of boron leads to a high rate of burning.

EXAMPLE 6

Figure 5:
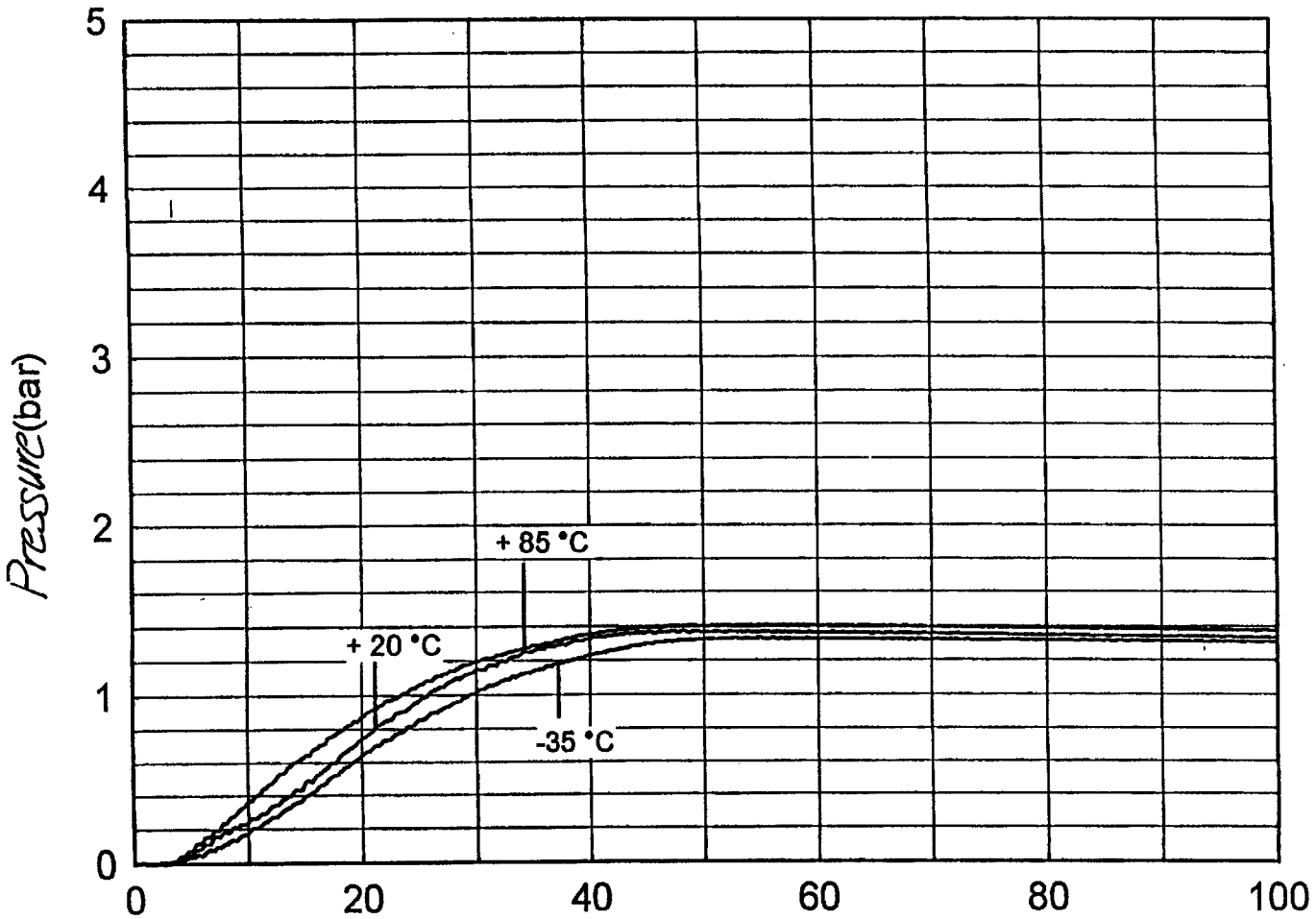

Has the aim of determining the temperature-dependence of a gas-generating composition containing guanyl urea dinitramide, $KNO_3$ and boron in a ratio of 66:32:2. As FIG. 5 shows, this gas-generating composition had an ideally low temperature-dependence.

What is claimed is:

1. A pyrotechnic, gas-generating composition consisting of guanyl urea dinitramide (GUDN); and an amount of a solid oxidizer to provide an excess of oxygen over said GUDN.

2. The pyrotechnic, gas-generating composition, according to claim 1, wherein the amount of said solid oxidizer is sufficient to maintain the amount of carbon monoxide generated by combustion of said GUDN below 600 ppm.

3. The pyrotechnic, gas-generating composition, according to claim 1, further comprising a substance that moderates the rate of combustion of said GUDN.

4. The pyrotechnic, gas-generating composition, according to claim 3, wherein said moderator comprises metallic boron.

5. The pyrotechnic, gas-generating composition, according to claim 4, wherein said metallic boron is finely divided and is present in an amount up to 10 wt %.

6. The pyrotechnic, gas-generating composition, according to claim 4, wherein said metallic boron is finely divided and is present in an amount of from 0.5 to 3 wt %.

7. The pyrotechnic, gas-generating composition, according to claim 1, further comprising up to 10 wt % (based on total solids) of a binder.

8. The pyrotechnic, gas-generating composition, according to claim 1, wherein said solid oxidizer is a compound selected from the group consisting of the nitrates, perchlorates, and permanganates of alkali metals.

9. The pyrotechnic, gas-generating composition, according to claim 1, wherein said GUDN is present in an amount from 5–95 wt %.

10. The pyrotechnic, gas-generating composition, according to claim 1, wherein said solid oxidizer is present in an amount from 5–50 wt %.

11. The pyrotechnic, gas-generating composition, according to claim 7, wherein said composition is pressed into tablet form.

* * * * *